US005350173A

United States Patent [19]

DiCerbo

[11] Patent Number: 5,350,173

[45] Date of Patent: Sep. 27, 1994

[54] SPORTS RACKET

[76] Inventor: Charles DiCerbo, 600 Bowes Rd., Concord, Ontario, Canada

[21] Appl. No.: 114,631

[22] Filed: Sep. 2, 1993

[51] Int. Cl.[5] ..... A63B 49/02

[52] U.S. Cl. ..... 273/73 G

[58] Field of Search ..... 273/73 R, 73 C, 73 D, 273/73 G

[56] References Cited

U.S. PATENT DOCUMENTS

| | | | |
|---|---|---|---|
| 3,642,283 | 2/1972 | Wilkens | 273/73 G |
| 3,874,666 | 4/1975 | Ross | 273/73 R |
| 4,828,260 | 5/1989 | Todd | 273/73 G X |
| 4,889,338 | 12/1989 | Keijiro | 273/73 R X |
| 4,995,608 | 2/1991 | von Hackewitz | 273/73 G X |
| 5,029,857 | 7/1991 | von Hackewitz | 273/73 G X |
| 5,106,086 | 4/1992 | Acosta | 273/73 R |
| 5,178,386 | 1/1993 | Tzeng | 273/73 G |

FOREIGN PATENT DOCUMENTS

| | | | |
|---|---|---|---|
| 1250329 | 2/1921 | Canada | 273/163 |
| 0221688 | 5/1987 | European Pat. Off. | 273/73 G |
| 3813872 | 11/1989 | Fed. Rep. of Germany | 273/73 G |

*Primary Examiner*—William E. Stoll

*Attorney, Agent, or Firm*—Dowell & Dowell

[57] ABSTRACT

This invention provides for a strung sports racket a resilient insert mountable onto the rim of the racket's head to absorb vibration during play. The resilient insert is mounted between free ends of the racket rim and absorbs movement of the racket's frame whereby the free ends of the rim between which the insert is mounted have components towards each other and components perpendicular to the plane of the rim.

2 Claims, 3 Drawing Sheets

SPORTS RACKET

BACKGROUND OF THE INVENTION

This application relates to a sports racket of the type used in a game such as tennis, racket ball or squash.

Players of racket sports such as tennis, racket-ball and squash sometimes develop arm and elbow disorders because of the effect of the vibration of the racket during play. The sports rackets are strung under tension and upon some conditions of ball impact, an objectionable vibration is transmitted from the strings to the racket frame and, via the racket frame, to the arm of the player, to cause a complaint commonly referred to as tennis elbow.

Modifications to racket designs have been tried in the past, to reduce the magnitude of the vibrations transmitted to the am of the player and thereby reduce the risk of injury. They have not proved wholly successful.

One modification taught by the prior art is shown in U.S. Pat. No. 1,250,329. That patent teaches the mounting of a resilient foam material between the strings of the racket under compression. This has some dampening effect on the vibration but most of the vibration is still transmitted to the player and it continues to be a problem.

Another type of racket modification is taught in Taiwanese patents 27535 and 120748. These patents disclose a discontinuity in the rim of the frame to provide spaced apart free ends and the filling of the space between the free ends with a hard plastics material plug that is secured in position by the racket strings. The arrangement does permit relative movement of the free ends of the frame but only in a direction substantially at right angles to the plane of the rim. This arrangement does absorb some of the shock of a poorly hit ball that would cause excessive vibration to be transmitted to the arm. However, it is not a very satisfactory answer. There is still objectionable vibration transmitted to the arm of the player. Further, the relative movement of the ends of the frame and the insert causes an objectionable noise. In several years of use and availability, the design has not been well received by players and the problem that it was intended to solve continues.

The present invention provides an insert of similar geometric proportions to the one of the Taiwanese patents but it is made of a resilient material that permits movement of the free ends of the frame at the discontinuity in a direction with a component substantially towards each other as well as in a plane substantially at right angels to the plane of the racket. This more free movement of the ends as they compress the resilient insert under conditions racket vibration results in the absorption of substantially more of the vibrations from impact of the ball and racket than the prior construction and is important in reducing vibration of the type that causes tennis elbow. The resilient insert also avoids the objectionable noise of the rigid plastics insert.

The present invention also provides an improved means for transmitting movement of the strings under conditions of excessive ball impact to the insert to further improve the operation of the racket.

It is an object of the present invention to reduce the vibration of the racket caused by the impact of the playing ball so that fewer players develop arm problems.

SUMMARY OF THE INVENTION

It is a further object of the present invention to provide a racket that has a comfortable feel and sound during play.

According to an aspect of the present invention there is provided, in.a strung racket having a frame with a handle, a rim and strings across the rim, the rim having a discontinuity at its base to provide two spaced free ends, the improvement of: a resilient insert in the space between said free ends of said rim to absorb movement of the frame at said free ends, the movement of the ends having components towards each other and components perpendicular to the plane of the rim whereby to dampen the effect of vibration transmitted to the handle from ball impact on the strings.

According to another aspect of the present invention, there is provided, in a strung racket having a frame with a handle, a rim and strings across the rim, the rim having a discontinuity at its base to provide two spaced free ends, an insert in the space between said free ends of said rim to absorb movement of the frame at said free ends, the movement of the ends having components towards each other and components perpendicular to the plane of the rim whereby to dampen the effect of vibration transmitted to the handle from ball impact on the strings, the improvement of: means for transmitting movement from the strings to said resilient insert comprising a strip overlaying the outer face of said rim and extending across said discontinuity, and tubular vibration-transmitting string sheaths one on each side of the resilient insert extending from said strip and through the rim to beyond the inside face of the rim, a racket string extending through each sheath.

BRIEF DESCRIPTION OF THE DRAWINGS

The invention will be readily understood after reference to the following drawings when read in conjunction with the following description. The drawings are as follows.

i)

ii)

iii)

DETAILED DESCRIPTION OF THE PREFERRED EMBODIMENTS

Figure 3:
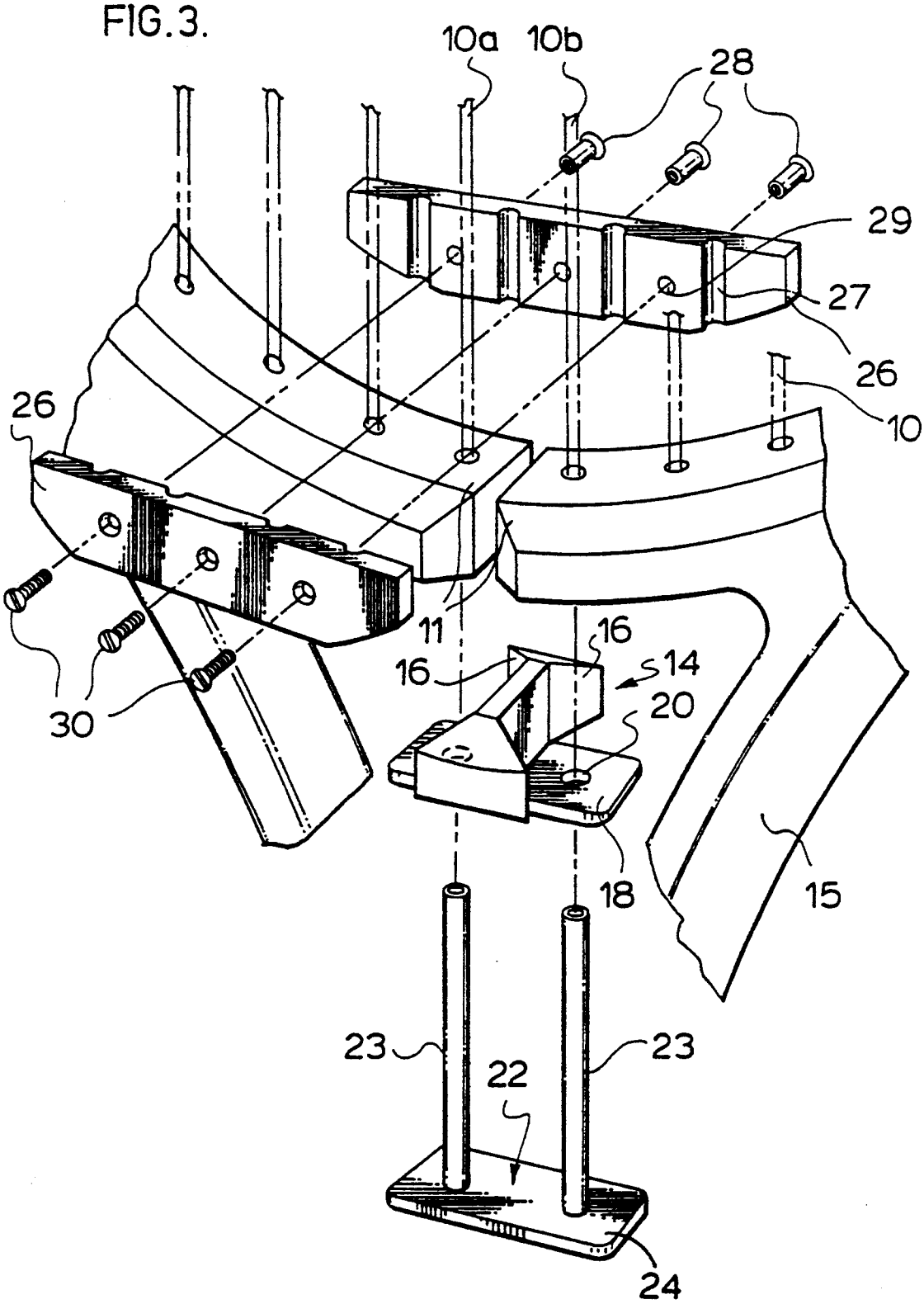
FIG. 3 is a perspective illustration showing the disposition of the parts in the rim of the racket head.

Referring to the drawings, there is shown a racket generally referred to by the numeral 8, strung under pressure with strings generally indicated by the numeral 10 of the conventional type. The racket frame has a handle 12 and a head with a rim 15 that has a discontinuity at its base to provide two spaced free ends that define between them a space to receive the resilient insert generally referred to by the numeral 14 (see FIG. 3).

The insert 14 is transversely sloped at surfaces 16 which are designed to permit the ends 11 to bend laterally of the plane of the rim of the racket head upon impact of a ball during play. This aspect of the shape of the insert is not new.

The insert 14 is made from a material resilient enough to flex and permit the free ends of the split racket head to move toward each other upon ball impact. This aspect of the movement of the ends of the rim is new and is important in the achievement of the improved shock absorption characteristics of this invention. The insert would also flex in response to the lateral movement of the end portions of the rim and would also absorb shock of this component.

The insert 14 is made of a resilient rubber or like material that will displace and reassert itself as required to provide shock absorption in use. Specification will vary from one racket design to another but the correct one for a racket is not difficult to determine by simple test.

The insert 14 is formed integrally with a base strip 18 that has holes 20. The base strip 18 functions as a mounting means for the insert 14 as will be apparent from the further description of the preferred embodiment provided below.

In the embodiment of the invention illustrated, a rigid strip member, generally referred to by the numeral 22 is used with the insert 14. The strip member 22 is formed with sheaths 23 that extend from the strip 24 and that accommodate the string at the base of the racket. The strip 24 overlies the strip 18 of the insert 14, in use. When mounted on the racket, the sheaths 23 extend through the holes 20 of the insert 14 and secure the insert 14 in the racket. The stringing of the racket is conventional. The strip member 22 is held in place in the racket by the tension of the string lengths 10*a*, 10*b* of string 10 which extends through and around the rim and is continuous. At the base of the head, the string 10 extends downwardly through one of the sheaths 23 to the strip on the outer face of the rim, along the strip and then upwardly through the other of the sheaths 23 and beyond. The string 10 is under conventional high tension and keeps the strips in overlying relation to the outer face of the rim.

Figure 1:
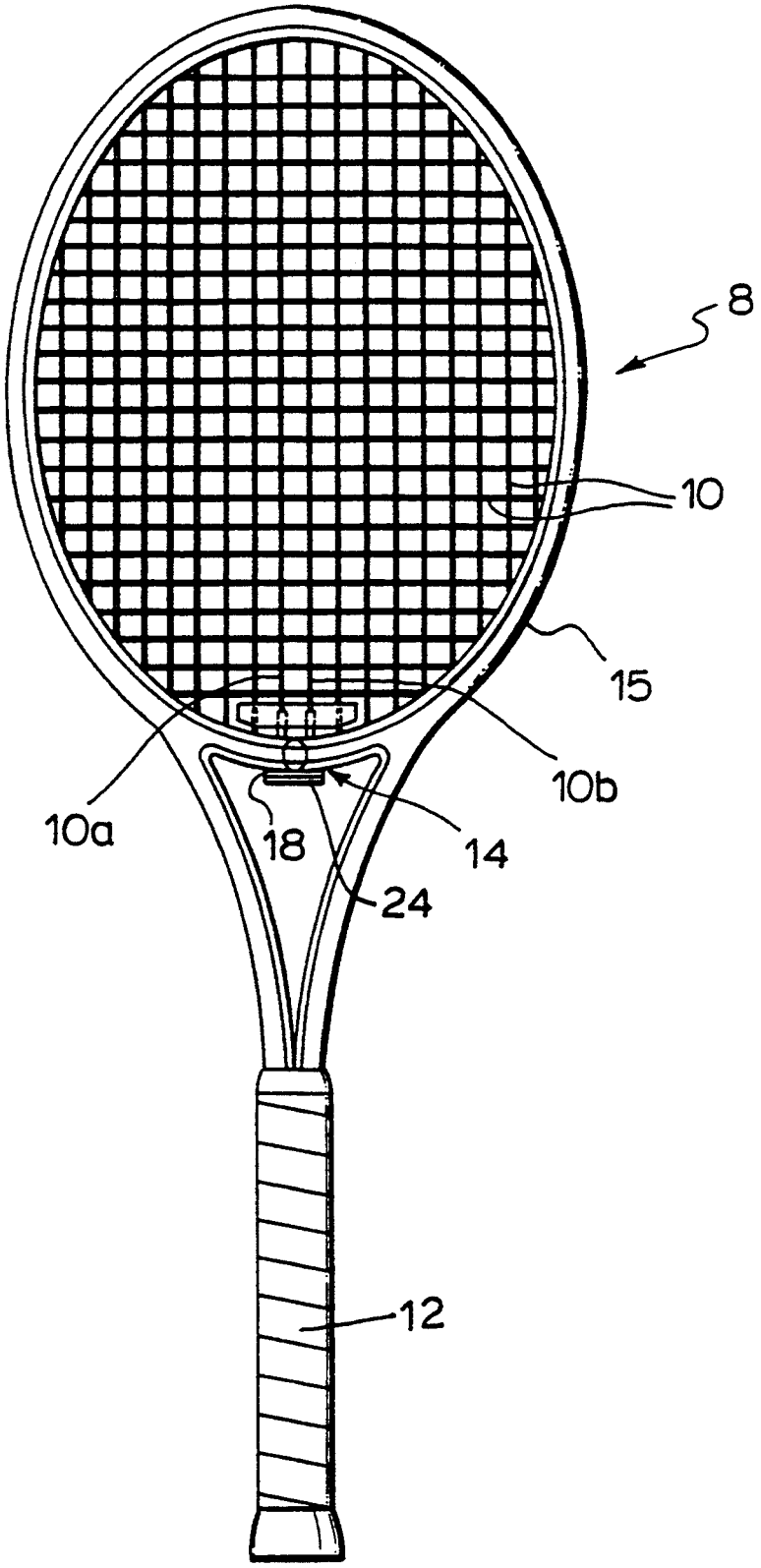
FIG. 1 is a front view of the racket showing the preferred embodiment of this invention mounted on the racket.
Figure 2:
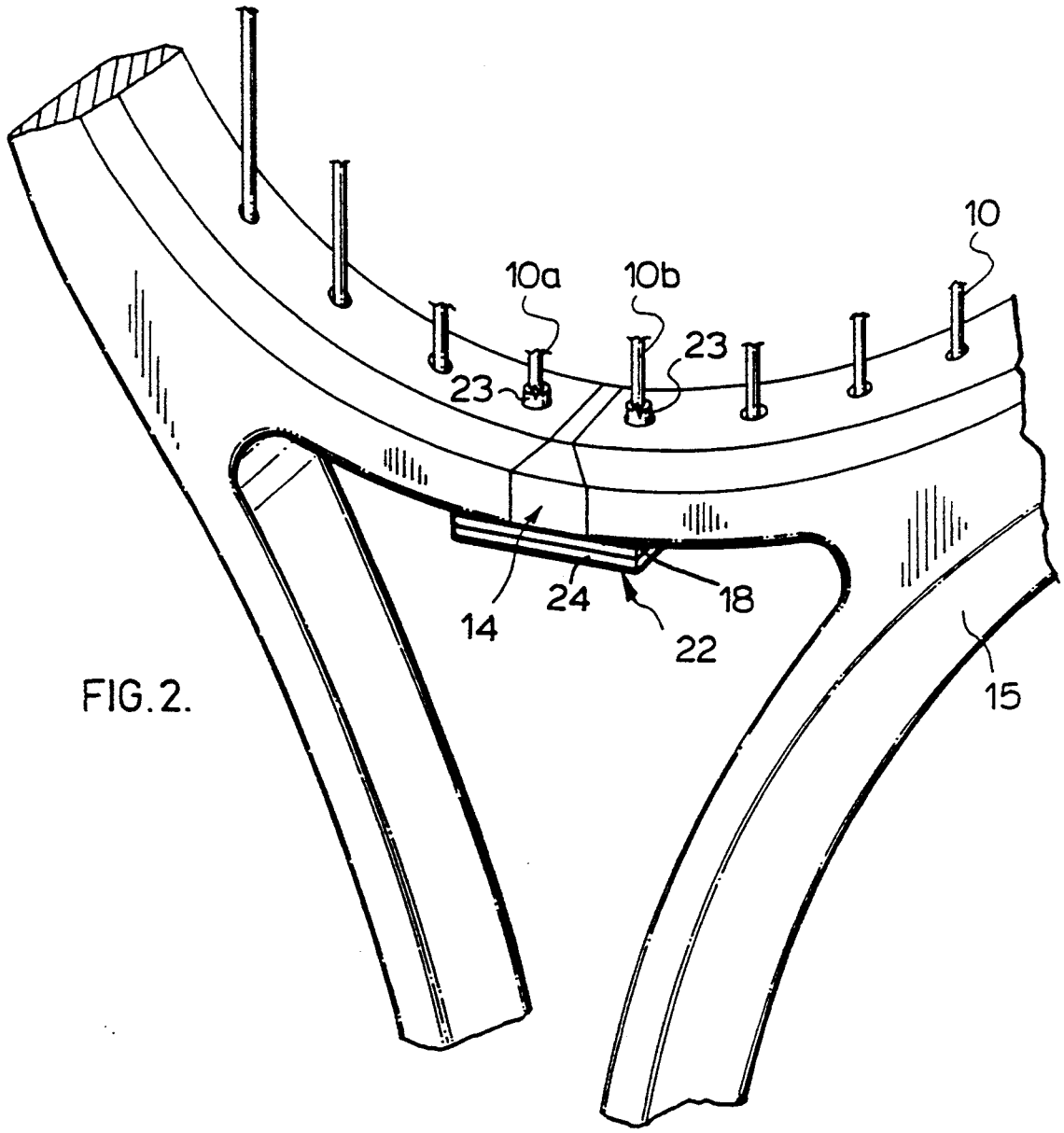
FIG. 2 is a perspective illustration showing the parts that are used in the manufacture of a tennis racket according to a preferred embodiment.

Base member 18 is made from a plastics material that is hard enough to achieve easy threading of the strings through the sheaths 23. The assembly is held in position by the strings with strip 22 against strip 18 as shown in FIG. 1.

Mountable around the free ends of the sheaths 23 are at least two resilient shock-absorbing clamping members 26. The clamping members overlap the strings of the racket 10 and the free ends of the sheaths 23 to transfer, during play, vibrations from the impact of a ball to the base member 22 and to the resilient insert 14. The clamping members are formed with grooves 27 to accomondate the strings 10 and the free ends of the sheaths 23.

The clamping members 26, in the preferred embodiment, are secured to each other by securement members 28 and 30.

The working of the invention will be apparent from the description given above. Generally, upon impact of the ball, the strings are stressed and the resilient insert 14 permits displacement of the free end portions of the racket head to reduce the amount of vibration transferred through the racket to the player.

Further reducing the amount of vibration are the resilient plastic clamping members 26 which absorb vibrations from the strings and transfer those vibrations to the sheaths 23 which in turn transfer the vibrations for absorption to the plastics resilient insert 14. The clamping members 26 also serve to give the racket a pleasant sound upon impact of the ball.

It will be apparent to those skilled in the art that the type of racket for which this invention has application would preferably be made of a metal that is an alloy including graphite in its composition.

It will be apparent to those skilled in the art that modifications to the preferred embodiment illustrated above will be possible without deviating from the substance of the invention as claimed in the claims. It is not intended that the description of the invention provided in this specification be read in a limiting sense. The illustrated design is a preferred one but is given by way of example only and not with the intention that it define the limits of the application of the principles of the invention to other design. The harder plastics sheaths for example might be mounted directly on the insert strip 20 rather than be on a separately formed element. Other modifications will be apparent.

The embodiments of the invention in which an exclusive property or privilege is claimed are defined as follows:

1. In a strung racket having a frame with a handle, a rim having an inside face and an outer face and strings through the rim, the rim having a discontinuity at its base to provide two spaced free ends, the improvement of:

a resilient insert between said free ends of said rim to absorb movement of the frame at said free ends, said resilient insert having opposite sides, the movement of the free ends having components towards each other and components perpendicular to a plane of the rim whereby to dampen the effect of the vibration transmitted to the handle from ball impact on the strings;

means for transmitting movement from the strings to said resilient insert comprising a strip overlaying the outer face of the rim and extending across the discontinuity;

tubular vibration-transmitting string sheaths on each of said sides of the resilient insert extending from said strip and through the rim and having free ends extending beyond the inside face of the rim, a string extending through each sheath; and resilient clamp means, said free ends of said sheaths extending beyond the inside face of said rim a distance to be engageable by said clamp means and, said clamp means clamping the free ends of said sheaths to their respective strings.

2. In a strung racket having a frame with a handle, a rim and strings across the rim, the rim having a discontinuity at its base to provide two spaced free ends, as claimed in claim 1, wherein said clamp means also clamps the strings laterally of said tubular string sheath.

* * * * *